US007435156B1

(12) United States Patent
Liu

(10) Patent No.: US 7,435,156 B1
(45) Date of Patent: Oct. 14, 2008

(54) REVERSIBLE BRASSIERE

(75) Inventor: Zhen Qiang Liu, Kwai Chung (HK)

(73) Assignee: Regina Miracle International Enterprises Limited, Hong Kong (HK)

( * ) Notice: Subject to any disclaimer, the term of this patent is extended or adjusted under 35 U.S.C. 154(b) by 0 days.

(21) Appl. No.: 11/738,592

(22) Filed: Apr. 23, 2007

(51) Int. Cl.
*A41C 3/10* (2006.01)
*A41C 35/00* (2006.01)

(52) U.S. Cl. ..... 450/92; 450/41; 450/93; 450/57; 450/39

(58) Field of Classification Search ..... 450/41–57, 450/92, 93, 39; 2/267, 268, 67, DIG. 2
See application file for complete search history.

(56) References Cited

U.S. PATENT DOCUMENTS 4,148,322 A * 4/1979 Jacaruso et al. ..... 450/40
4,375,445 A * 3/1983 Cole et al. ..... 264/250
4,414,691 A * 11/1983 Estruch ..... 2/67
4,481,951 A * 11/1984 Cole et al. ..... 450/20
6,863,589 B2 * 3/2005 Cano ..... 450/65
7,306,505 B2 * 12/2007 Barbour et al. ..... 450/30

* cited by examiner

*Primary Examiner*—Gloria Hale
(74) *Attorney, Agent, or Firm*—Ostrolenk, Faber, Gerb & Soffen, LLP

(57) ABSTRACT

A reversible bra that includes two breast cups. Each breast cup includes a first side outermost layer and a second side outermost layer. Between the two outermost layers there is captured an underwire assembly that extends along or adjacent at least part of the lower peripheral region of the breast cup. The breast cup includes an elongate zone of reduced thickness that extends along or adjacent at least part of the underwire assembly.

21 Claims, 3 Drawing Sheets

REVERSIBLE BRASSIERE

FIELD OF THE INVENTION

The present invention relates to a reversible brassiere.

BACKGROUND

Bras that exist on the market are generally worn in one condition. Bras that are available do not readily lend themselves to being reversed such that the side of a bra normally touching the skin of the wearer is presented away from the wearer. Whilst it may be possible to reverse an existing bra, issues exist in respect of the fasteners at the end of the chest bands. These may become less convenient to use when reversed. Furthermore, by reversing a bra the new concave cup surface which was originally the convex surface, may wrinkle. Also the new convex surface (which was originally the concave surface) would not have the same aesthetically pleasing looking cup shape. This is particularly so for moulded bras that consist of a plurality of layers of laminated and moulded material. Furthermore bras that incorporate an underwire structure also do not readily lend themselves to being reversible without similar or the same undesired effects from occurring. For instance, where the underwire structure is attached to the inner side of the bra, when the bra is reversed and the inner side becomes the outer side, the underwire structure will become exposed and might result in unsightliness.

Accordingly it is an object of the present invention to provide a reversible bra that addresses the above mentioned disadvantages and/or which will at least provide the public with a useful choice.

BRIEF DESCRIPTION OF THE INVENTION

A first aspect of the present invention is a reversible bra that includes two breast cups that each includes a first side outermost layer and a second side outermost layer between which there is captured an underwire assembly that extends along or adjacent at least part of the lower peripheral region of the breast cup, wherein the breast cup includes an elongate zone of reduced thickness that extends along or adjacent at least part of the underwire assembly and on the opposite side thereof to the lower periphery.

Preferably the zone of reduced thickness is defined by at least one of the first side outermost layer and second side outermost layer.

Preferably the zone of reduced thickness is defined by compression of at least one of the first side outermost layer and second side outermost layer at the zone.

Preferably a foam core is captured between the first side outermost layer and second side outermost layer and wherein the zone of reduced thickness is at least in part defined by the foam core.

Preferably the foam core comprises two layers of foam material and intermediate of which the underwire assembly is located.

Preferably the first side outermost layer and second side outermost layer are laminated with each other.

Preferably the zone of reduced thickness is no greater than 1 mm thick.

Preferably the breast cup is generally of a thickness no greater than 3 mm thick and at the zone of reduced thickness the thickness is no greater than 1 mm.

Preferably the first side and second side outermost layers and the foam core are contiguous and coextensive each other.

Preferably the underwire assembly comprises a rigid elongate member and a flexible material casing about at least part of the rigid elongate member.

Preferably the bra has been formed by a mold to subject the first side outermost layer and the second side outermost layer to heat molding to introduce cup shapes into the bra at each of the breast cups, wherein each of the breast cups has been subjected to such heat molding twice, a first instance where the first side outermost layer is located on the concave side in the cup shaped mold and a second instance where it is located on the convex side.

Preferably the first side outermost layer is of a different characteristic to the second side outermost layer.

Preferably the bra is a molded bra.

Preferably the bra is a seamless bra.

A second aspect of the present invention is a bra comprising a) two breast cups that each defines a breast cup region to receive a breast of the wearer, b) a chest band portion extending from each breast cup, c) an underwire assembly for each breast cups each underwire assembly located adjacent a lower periphery of each breast cup, wherein each breast cup and chest band has a first face side and an opposed second face side, that in a first configuration of the bra places the first face side in a condition for engagement with the chest of the wearer and in a second configuration of the bra places the second face side in a condition for engagement with the chest of the wearer, the movement of the bra between its first and second configurations involving the hand manipulation of each breast cup to reverse its curvature, and wherein, intermediate of each breast cup region and its respective underwire assembly the breast cup includes an elongate zone of reduced thickness that extends immediately adjacent at least part of the underwire assembly and acts as a hinge to assist in isolating the influence of underwire on the shape of the breast cup.

A further aspect of the present invention is a method of forming a reversible bra that includes two breast cups, each of which has a first side outermost layer and a second side outermost layer that by virtue of hand manipulation of each breast cup are selectively capable of being alternately disposed on a concave and convex side of the breast cup, the method including:

a) in a mold that includes a first mold part presenting a convex formation and a second mold part presenting a concave formation to form a breast cup shape in overlying layers of moldable material, placing an assembly of overlying layers of moldable material that includes said first side outermost layer and said second side outermost layer intermediate of said first and second mold parts with the first side outermost layer more proximate to said first mold part, b) applying heat and pressure to said assembly by said first and second mold parts to introduce said breast cup shape therein, c) placing said assembly intermediate of said first and second mold parts with the second side outermost layer more proximate to said first mold part, d) applying heat and pressure to said assembly by said first and second mold parts to introduce a reversal of said breast cup shape that was introduced in step (b) above, in said assembly.

Preferably said assembly includes an underwire assembly that is located intermediate of said first side outermost layer and said second side outermost layer and wherein the first and second mold parts introduce an elongate zone of reduced thickness adjacent of and on the breast cup side of said underwire assembly.

Still a further aspect of the present invention is a fastening arrangement of a bra that includes a first chest band portion and a second chest band portion that are releasably fastenable together, said arrangement including a) a hook portion located at the end of said first chest band portion that includes a mounting body engaged to said first chest band and a hook that projects from said mounting body, b) an array of hook receiving pockets formed in the second chest band portion, said array extending inward from the end of said second chest band portion, each of the hook receiving pockets defined between two layers of material that are included in said second chest band portion, wherein an opening exists for each of said pockets at one of the upper and lower elongate extending edges of said second chest band portion for said hook to pass through.

Still a further aspect of the present invention is a reversible bra that includes a fastening arrangement as herein before described.

Still a further aspect of the present invention is a reversible bra as herein before described that includes a fastening arrangement as herein before described.

The present invention may also broadly comprise the parts, elements and features referred to or indicated in the specification of the application, individually or collectively, and any or all combinations of any two or more of the parts, elements or features, and where specific integers are mentioned herein which have known equivalents in the art to which this invention relates, such known equivalents are deemed to be incorporated herein as if individually set forth.

Where there is reference to the word "layer" it is also to be understood that it may have its common definition and, in addition, the layer could consist of one panel or may have regions that are defined by two or more panels that are joined and that may each be of a different characteristic (e.g. color, thickness, material, orientation, size).

Where there is reference to the word "layer", in addition to the common definition of "layer", it is also to be understood that the layer may be of one layer or of more layers of the same or dissimilar characteristics (e.g. color, thickness, material, orientation, size) that are engaged to each other by such methods as lamination or by other methods in an at least partially overlapping configuration.

The phrase "seamless bra" means that the bra is visibly substantially seamless, in that the edges of the bra are finished in a seamless way, for example by ultrasonic welding, or by folding the edge of an outward layer over and affixing it to an inner layer by a non-stitching means, or by some other means that is substantially without seams. Seams may however be found inside the bra structure where it is not externally visible, or at less conspicuous visible external places such as the region where the shoulder strap is attached to a bra cup region or the region where hook or eye tape is connected to the chest bands.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement, all need to be present but other features can also be present. Related terms such as "comprise" and "comprised" are to be interpreted in the same manner.

BRIEF DESCRIPTION OF THE DRAWINGS

A preferred form of the present invention will now be described with reference to the accompanying drawings in which.

DETAILED DESCRIPTION OF THE INVENTION

Figure 1:
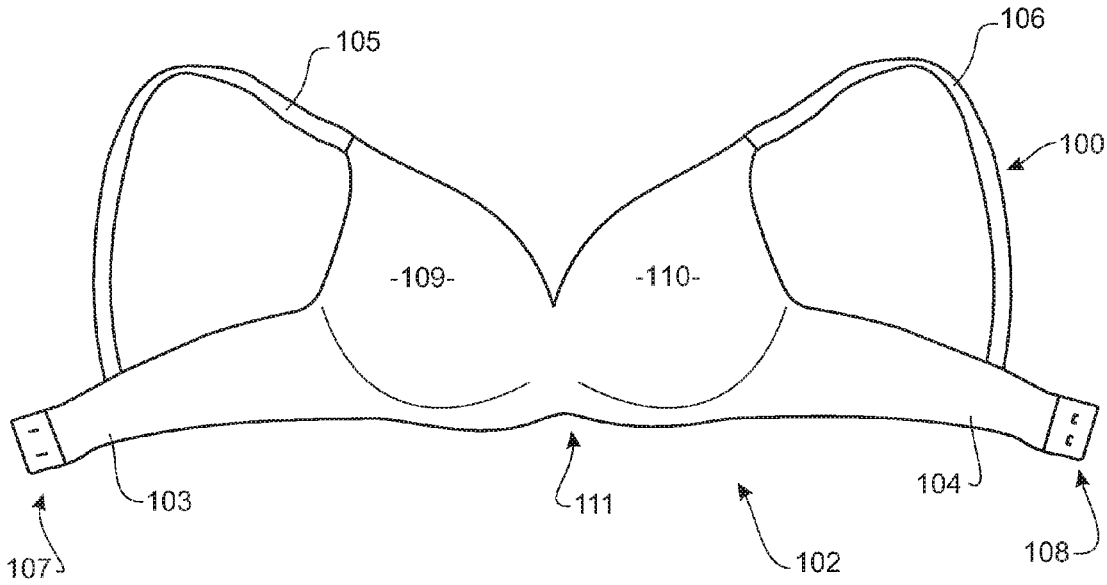
FIG. 1 is an elevation view of a bra of the present invention.

With reference to FIG. 1 there is shown a bra 100 that may generally be defined by a breast cup region 102, chest bands 103 and 104 and shoulder straps 105 and 106. The shoulder straps 106 and 105 may extend between the breast cup region 102 and each of the chest bands 103 and 104 respectively.

Such shoulder straps may however be optional as it is envisaged that the bra may also be of a strapless version. Indeed whilst reference is herein made to a bra, it is envisaged that the assembly of panels component parts and items to define such, may alternatively be incorporated into other garments such as, for example, evening dresses or bathing suits or similar garments.

At the ends of each of the chest bands may be fasteners 107 and 108 that are mutually cooperative to allow for the bra to be fastened about the chest of a wearer.

The bra may be seamless and made from materials at least some of which are molded or moldable and that are engaged to each other preferably at least in part by lamination.

Fastening of various components of sections of the bra may occur by adhesives and/or ultrasonic welding or other forms of welding and/or by stitching. Stitching is not the preferred form of assembly. In the most preferred form the bra of the present invention is a seamless bra that incorporates little or no stitching at all. In the most preferred form the or at least some of the layers of material of the bra are continuous over both breast cups and both chest bands.

The breast cup region 102 preferably defines two breast cups 109 and 110 that are adjacent to each other and between which may extend an intermediate bridge region 111. At least some of the material components defining the breast cups 109 and 110 are continuous over the entire breast cup region 102, including across the bridge region 111. Alternatively some or all of the material components may only be present in at least part of the breast cups 109 and 110.

In the preferred form, at least one of the material components of the breast cup region 102 is continuous over the breast cup region 102 and preferably also over the bridge region. However in alternative forms each of the breast cups 109 and 110 may be separately predefined and may be affixed together at the bridging region 111 to define, once assembled, a breast cup region 102.

Additional components, layers or plies of material may be provided with the materials defining the breast cup region and/or the bra, in addition to those herein defined.

Variations to the bra shown in FIG. 1 may include where the chest bands 104 and 103 are unitary and may extend along the lower periphery of the breast cup region 102. The bra may be a front opening bra where mutually cooperative fasteners are positioned at the bridge region 111 to allow the bra to be opened and fastened at that region.

Figure 2:
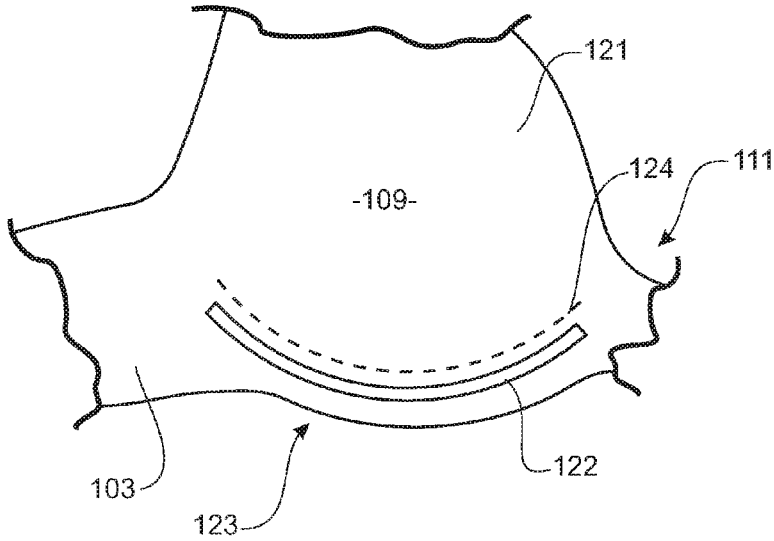
FIG. 2 is a view of part of a breast cup.

With reference to FIG. 2 there is shown a breast cup 109. The breast cup 109 preferably includes two outward or outermost layers. One of the outward layers is in layer 121. The other outward layer 128 (but not visible in FIG. 2) is located on the opposite side of the bra to the outward layer 121. Captured intermediate of these two layers of the breast cup may be an underwire or underwire structure 122.

The outward layers are preferably of a flexible material such as a fabric material. Intermediate of the outward layers may be further components of the breast cup such as a foam pad or padding and any additional layers of materials such as a non-stretch panel located at the bridge region 111 to ensure the bridge has sufficiently rigid characteristics.

The outward layer 121 may be of a different characteristic to the layer 128. For example the layers may be of different color or material or shape.

The underwire structure 122 is located adjacent the lower peripheral region 123 of the breast cup. The underwire structure 122 is preferably of a curved formation. The curved formation in elevation view is as shown in FIG. 2.

Figure 3:
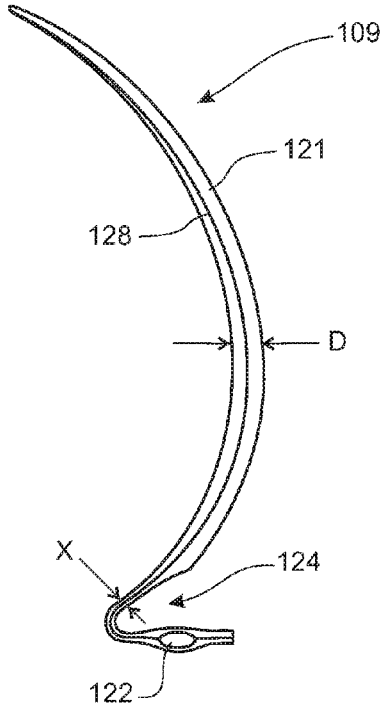
FIG. 3 is a cross-sectional view through a breast cup.

Immediately adjacent to the underwire structure 122 and on the breast cup side of the underwire structure 122 (rather than on the lower peripheral region side of the underwire) is a zone of reduced thickness 124. This zone of reduced thickness 124 preferably extends adjacent to the entire length of the underwire structure 122. With reference to FIG. 3, it can be seen that the zone of reduced thickness is positioned adjacent the underwire structure 122. The zone of reduced thickness is preferably an elongate zone. It defines a construction of the breast cup that has a thickness X that is less than the thickness D that generally exists at other regions of the breast cup above the zone 124. The reduced thickness may be defined as a result of at least one of the layers at that zone having been compressed or shaped to define such a reduction of thickness at the zone 124. This may be of one or both of the outward layers 121 and 128 or any other layers of material thereat.

In the most preferred form such a reduction in thickness of the layers of material at the zone 124 is as a result of both layers 121 and 128 of materials at that zone having been formed to reduce thickness thereat.

The zone of reduced thickness 124 facilitates a reversing of the breast cups. With reference to FIG. 3 the outward layer 121 is on the convex side of the breast cup 109 and the outward layer 128 is on the concave side. By manipulating the breast cup, for example by hand manipulation, the breast cup can be reversed such that the outward layer 128 becomes disposed on the convex side of the breast cup and the outward layer 121 becomes disposed on the concave side. The zone of reduced thickness 124 results, to some extent, in an isolation or increased isolation of the underwire structure 122 from the breast cup 109. As a result of the increased isolation provided by zone 124, there is a reduction in any bias that might exist due to the outward layer 121 or the other outward layer 128 remaining on the convex side (or the concave side as the case may be). The isolation will thereby improve the visual appearance and shaping of a breast cup where either of the outward layers 121 and 128 can be presented either away from the body of the wearer or to touch the skin of the wearer.

Figure 4:
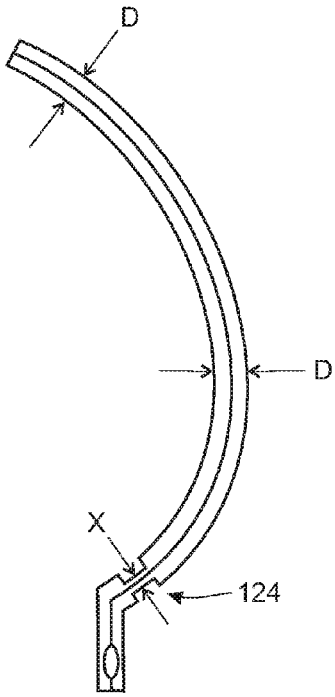
FIG. 4 is a cross-sectional view through an alternative form of breast cup.
Figure 5:
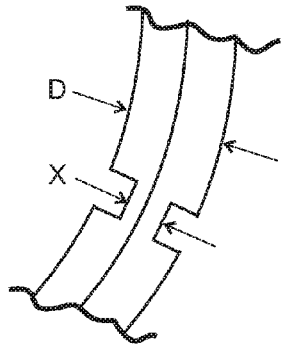
FIG. 5 is a close up view of part of FIG. 4.

With reference to FIG. 3, it can be seen that the breast cup may reduce in thickness at the region of or towards its neckline periphery. In the most preferred form such tapering to the neckline occurs for at least one or all of the layers that define the breast cup. With reference to FIG. 4 a variation is shown where the thickness across the entire breast cup, save for at the zone 124, is constant.

The zone of reduced thickness 124 effectively acts as a hinge to facilitate the reversing of the breast cup.

In the most preferred form the zone of reduced thickness is no more than one millimeter thick. This distance is indicated by X in the drawings.

Formation of the bra of the present invention may include the molding and laminating of overlying layers of material to define the bra or at least the breast cup. In the molding process a feature of the mold may exist, that simultaneous to the mold forming of the layers of material to the breast cup shape, also introduces the zone of reduced thickness. In the preferred form the distance between the upper and lower mold portions at the zone of reduced thickness is no more than one millimeter. This distance is less than the distance at least a substantial part of the molds to define the breast cup region.

In one preferred form of the present invention the bra consists only of two outward layers of fabric material. Alternatively the bra may also include a foam core, which preferably comprises two layers of foam material laminated to each other and spans the breast cup region. The underwire for each breast cup is located between the outward layers 121 and 128 and where a foam core is provided, the underwire is also captured intermediate of the layers of foam defining the core. Where a foam core is provided, the two outward layers of fabric material are disposed on the respective sides of the foam core and encase the foam core. There may be additional layers of material between the foam core and the outward layers of fabric material. The layers of material are preferably laminated to or with each other, preferably with the help of adhesives.

The or some of the fabric material used may be of a material known by model number CMF-7440MU of Friendly Foundate Ltd. This fabric is made of 80% Tactel and 20% lycra. The fabric layer may have a make-up of approximately 80% Tactel 40d/34f and 20% lycra 40d and of a weight of, for example, 190 g/m2. The foam used is preferably a polyurethane foam of a density of, for example, 30-40d. Adhesives may be used to facilitate lamination of the or some of the layers of material. An adhesive such as glue HM-1 of Forbo Swift Adhesives SA may be used for laminating a fabric layer to a foam layer. A glue such as RM-30 of Ultra Energy Adhesive Trading Co., Ltd. may be used for laminating two foam layers.

In the most preferred form the breast cup has a substantially uniform thickness across the breast cup other than at the region of reduced thickness and at the peripheral regions. The uniform thickness is preferably no more than 3 millimeters. This thickness should avoid the wrinkling of any of the layers of material when the cup is moved "to and fro". The thickness at free edges of the cups may be thinner such as a result of the edge being ultrasonically bonded.

In a preferred form of manufacturing of the bra of the present invention, each breast cup is preferably molded twice. This preferably occurs in the same mold. A first molding occurs where the outward layer 121 is on the convex side and a second molding step may be where on the outward layer 121 is on the concave side. Such two step molding will assist in forming of the breast cups to facilitate the reversibility.

Figure 6:
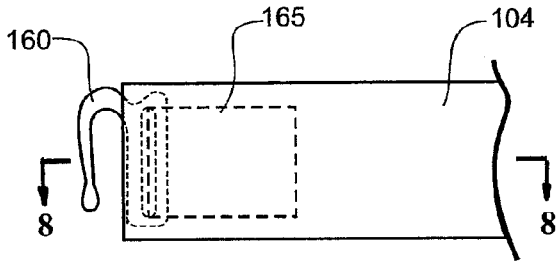
FIG. 6 is a view of an end of one of the chest bands.
Figure 7:
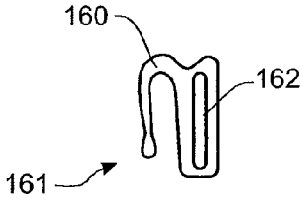
FIG. 7 is a view of a hook for use at the chest band.

With reference to FIG. 6 there is shown a chest band 104. A hook 160 may be affixed to the chest band 104. The hook 160 provides a means for securing the chest band 104 to the opposing chest band 103.

Figure 8:
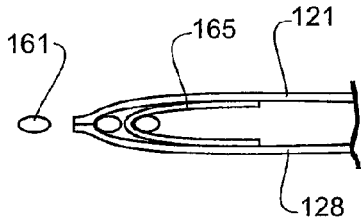
FIG. 8 is a cross-sectional view through section 8-8 of FIG. 6.

The hook 160 has an eyelet 162 and a hook projection 161. With reference to FIG. 8, a stabilizer 165 may be folded back through the eyelet 162 of the hook 160. The stabilizer 165 is preferably non-stretchable cloth. The stabilizer 165 and the hook 160 may be secured between the outward layer 121 and the outward layer 128 of the chest band 104. The stabilizer 165 and the hook 160 are preferably secured in place by a heat seal adhesive film. The ends of the outward layer 121 and the outward layer 128 (at the distal end of the chest band) may be ultrasonically cut and bonded to each other to encompass the hook 160 and the stabilizer 165. The hook projection 161 of the hook 160 may extend out of the chest band 104 so it is free to engage with a complementary zone of the opposing chest band 103.

Figure 9:
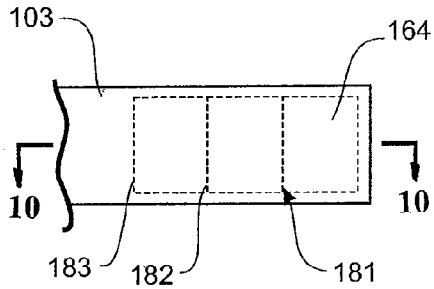
FIG. 9 is a view of the other chest band.
Figure 10:
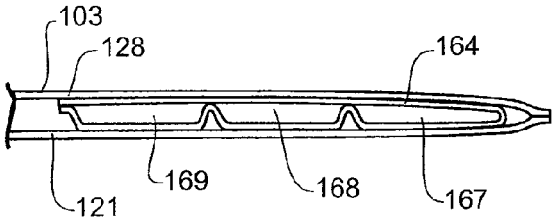
FIG. 10 is a cross-sectional view through section 10-10 of FIG. 9.
Figure 11:
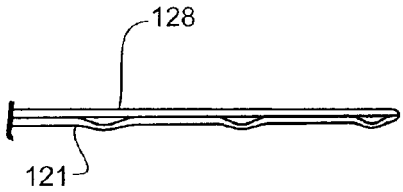
FIG. 11 is a plan view of FIG. 9.

With reference to FIG. 9 there is shown a chest band 103 which can secure to the opposing chest band 104. The chest band 103 has a stabilizer 164 which is preferably located between the outward layer 121 and the outward layer 128. The stabilizer 164 is preferably non-stretchable cloth which is folded back onto itself. The stabilizer 164 has a plurality of seams where one side of the folded stabilizer 164 is fixed to its other side. The seams 181, 182 and 183 define the sleeves 167, 168 and 169. The sleeves 167, 168 and 169 provide complimentary zones in the chest band 103 in which to engage the hook projection 161 of hook 160 which is located on the chest band 104.

In use, the bra may be secured to the user by engaging the hook projection 161 with a sleeve 167, 168 or 169. The user can adjust the tightness of the bra by positioning the hook projection 161 in a different sleeve. The bra would be looser for example, if the hook projection 161 was engaged with sleeve 167 compared with if it were engaged with sleeve 169. The attachment system allows chest band 104 to be attached to chest band 103 irrespective of whether the bra is worn with its reverse side on the inside or the outside.

While the present invention has been described with reference to particular embodiments thereof, it will be understood that such embodiments are susceptible of modifications and variations without departing from the scope of the present invention and that the invention will include all embodiments falling within the scope of the appended claims.

The invention claimed is:

1. A reversible bra that includes two breast cups, each of the breast cups including a first outermost layer and a second outermost layer between which is captured an underwire assembly that extends along and is adjacent to at least part of a lower edge of the breast cup, wherein each of the breast cups includes an elongate zone of reduced thickness, the reduced thickness being less than a thickness of the portion of the breast cup formed into the elongate zone of reduced thickness prior to formation of the elongate zone of reduced thickness, the elongate zone of reduced thickness being adjacent to at least part of the underwire assembly and on the opposite side thereof from the side of the underwire assembly adjacent to the lower edge of the breast cup, the reversible bra in a first configuration having the first outermost layer on a concave side of the breast cup and in a second configuration having the second outermost layer on a concave side of the breast cup, the bra being movable between its first and second configurations by manipulation of each breast cup about the elongate zone of reduced thickness acting as a hinge.

2. A reversible bra as claimed in claim 1 wherein the zone of reduced thickness is formed by at least one of the first outermost layer and the second outermost layer.

3. A reversible bra as claimed in claim 2 wherein the zone of reduced thickness is formed by compression of at least one of the first outermost layer and the second outermost layer at the zone.

4. A reversible bra as claimed in claim 1 wherein a foam core is captured between the first outermost layer and the second outermost layer and wherein the zone of reduced thickness at least in part includes the foam core.

5. A reversible bra as claimed in claim 4 wherein the foam core comprises two layers of foam material and intermediate of which the underwire assembly is located.

6. A reversible bra as claimed in claim 1 wherein the first outermost layer and the second outermost layer are laminated with each other.

7. A reversible bra as claimed in claim 1 wherein the first outermost layer and the second outermost layer are laminated to each other.

8. A reversible bra as claimed in claim 1 wherein the zone of reduced thickness is no greater than 1 mm thick.

9. A reversible bra as claimed in claim 1 wherein the breast cup is generally of a thickness no greater than 3 mm thick and at the zone of reduced thickness the thickness is no greater than 1 mm.

10. A reversible bra as claimed in claim 1 wherein the first and the second outermost layers and the foam core are contiguous and coextensive each other.

11. A reversible bra as claimed in claim 1 wherein the underwire assembly comprises a rigid elongate member and a flexible material casing about at least part of the rigid elongate member.

12. A reversible bra as claimed in claim 1 wherein the bra has been formed by a cup shaped mold applying heat and pressure to introduce reversible cup shapes into the bra at each of the breast cups, the reversible cup shapes of each of the breast cups having been formed by application of the cup shaped mold to each of the breast cups twice, a first time when the first outermost layer is located on a concave side of the cup shaped mold, and a second time when the first outermost layer is located on a convex side of the cup shaped mold.

13. A reversible bra as claimed in claim 1 wherein the first outermost layer is of a different characteristic than the second outermost layer, the different characteristic being selected from one of the group consisting of color, thickness, material orientation, and size.

14. A reversible bra as claimed in claim 1 wherein the bra is a molded bra.

15. A reversible bra as claimed in claim 1 wherein the edges of the bra are finished in a seamless manner.

16. A reversible bra comprising a) two breast cups, each breast cup including a breast region adapted to receive a breast of a wearer of the bra and includes a first face surface and an opposed second face surface, b) a chest band extending from each breast cup, the chest band including a first face surface and an opposed second face surface, c) an underwire assembly for each breast cup, each underwire assembly being located adjacent to a lower periphery of the breast cup, wherein in a first configuration of the bra, the first face surface of each breast region is located on a concave side of the breast region and the first face surface of each chest band is arranged to engage a chest of a wearer of the bra, and in a second configuration of the bra, the second face surface of the breast region is located on a concave side of the breast region and the second face surface of each chest band is arranged to engage a chest of a wearer of the bra, the bra being movable between its first and second configurations by manipulation of each breast region to reverse its curvature, and wherein, intermediate of each breast region and its respective underwire assembly the breast cup includes an elongate zone of reduced thickness that extends immediately adjacent at least part of the underwire assembly and that acts as a hinge to assist in limiting influence of the underwire assembly on the shape of the breast cup and to permit the manipulation of the breast region about the elongate zone of reduced thickness to reverse its curvature, the reduced thickness being less than a thickness of the portion of the breast cup formed into the elongate zone of reduced thickness prior to formation of the elongate zone of reduced thickness.

17. A method of forming a reversible bra that includes two breast cups, that each of the breast cups having a first outermost layer and a second outermost layer, the first outermost layer and the second outermost layer being operable to be alternatively disposed on one of a concave and a convex side of the breast cup by manipulation of the breast cup, the method including:

a) obtaining an assembly of overlying layers of moldable material for at least the two breast cups, said overlying layers of moldable material including said first outermost layer and said second outermost layer, b) placing, in a mold that includes a convex mold part and a concave mold part, said assembly of overlying layers of moldable material in a position intermediate of said convex mold part and said concave mold part with said first outermost layer more proximate to said convex mold part, c) applying heat and pressure to said assembly by said convex mold part and said concave mold to laminate said assembly and to form first breast cup shapes in said assembly, d) placing said assembly intermediate of said convex mold part and said concave mold part with said second outermost layer more proximate to said convex mold part, and e) applying heat and pressure to said assembly by said first and second mold parts to form a second breast cup shapes in said assembly, the second breast cup shapes having a curvature which curves in an opposite direction to a direction of curvature of the first breast cup shapes, the second breast cup shapes being formed in the same location in said assembly as the first breast cup shapes.

18. A method as claimed in claim 17 wherein said assembly further includes an underwire assembly and wherein said method further includes locating said underwire assembly intermediate of said first outermost layer and said second outermost layer and adjacent to an edge of said assembly and introducing an elongate zone of reduced thickness adjacent to and on the breast cup side of said underwire assembly by using said convex mold part and said concave mold part.

19. A fastening arrangement of a reversible bra that includes a first chest band portion and a second chest band portion that are releasably fastenable together, the reversible bra including two breast cups, each of the breast cups including a first outermost layer and a second outermost layer, the reversible bra in a first configuration having the first outermost layer on a concave side of the breast cup and in a second configuration having the second outermost layer on a concave side of the breast cup, the bra being movable between its first and second configurations by manipulation of each breast cup to reverse its curvature, each breast cup forming a reproducible cup shape in a first position where the first outermost layer is on a concave side of the breast cup and alternatively forming a reproducible cup shape in a second position where the first outermost layer is on a convex side of the breast cup, thereby allowing each of the breast cups to be reversed, said fastening arrangement further including a) a hook portion located at the end of said first chest band portion that includes a mounting body engaged to said first chest band and a hook that projects from said mounting body, b) an array of hook receiving pockets formed in the second chest band portion, said array extending inward from the end of said second chest band portion, each of the hook receiving pockets defined between two layers of material that are included in said second chest band portion, wherein an opening is defined by each of said pockets at one of the upper and lower elongate extending edges of said second chest band portion for said hook to pass through.

20. A reversible bra including two breast cups, each of the breast cups including a first outermost layer and a second outermost layer, the reversible bra in a first configuration having the first outermost layer on a concave side of the breast cup and in a second configuration having the second outermost layer on a concave side of the breast cup, the bra being movable between its first and second configurations by manipulation of each breast cup to reverse its curvature, each breast cup forming a reproducible cup shape in a first position where the first outermost layer is on a concave side of the breast cup and alternatively forming a reproducible cup shape in a second position where the first outermost layer is on a convex side of the breast cup, thereby allowing each of the breast cups to be reversed, the reversible bra including a fastening arrangement as claimed in claim 19.

21. A reversible bra as claimed in claim 1 that further includes a fastening arrangement for first and second chest band portions of the bra wherein said fastening arrangement includes a) a hook portion located at the end of said first chest band portion that includes a mounting body engaged to said first chest band and a hook that projects from said mounting body, b) an array of hook receiving pockets formed in the second chest band portion, said array extending inward from the end of said second chest band portion, each of the hook receiving pockets defined between two layers of material that are included in said second chest band portion, wherein an opening is defined by each of said pockets at one of the upper and lower elongate extending edges of said second chest band portion for said hook to pass through.

* * * * *